United States Patent [19]

Weiner

[11] Patent Number: 4,505,399

[45] Date of Patent: Mar. 19, 1985

[54] TAMPER-INDICATING DEVICE AND METHOD

[76] Inventor: Robert C. Weiner, c/o Wright State University, 3640 Colonel Glenn Hwy., Dayton, Ohio 45435

[21] Appl. No.: 622,814

[22] Filed: Jun. 21, 1984

[51] Int. Cl.[3] ..... B65D 31/02

[52] U.S. Cl. ..... 215/230; 215/203

[58] Field of Search ..... 215/230, 203; 220/359

[56] References Cited

U.S. PATENT DOCUMENTS

| | | | |
|---|---|---|---|
| 3,826,221 | 7/1974 | Ross | 215/230 X |
| 3,827,591 | 8/1974 | Spelman et al. | 215/38 A |
| 3,896,965 | 7/1975 | Cornell | 220/359 |
| 3,899,295 | 8/1975 | Halpern | 215/230 X |
| 3,923,198 | 12/1975 | Brochman | 215/203 X |
| 3,935,960 | 2/1976 | Cornell | 220/359 X |
| 4,429,803 | 2/1984 | Butterfield | 215/230 X |
| 4,432,462 | 2/1984 | Newkirk | 215/230 X |

*Primary Examiner*—Steve M. Pollard

*Attorney, Agent, or Firm*—Biebel, French & Nauman

[57] ABSTRACT

A tamper-indicating device which is attached by adhesives to a closure and which includes a sheet of material, sensitive to an ambient condition such as light or oxygen, that effects a time-delayed, irreversible change in appearance in response to exposure to the condition, which is automatically exposed upon the opening of a closure, such as the removal of a bottle cap from a bottle. The device consists of a lower sheet impermeable to the ambient condition and shaped to be attached at an underside to a lower closure member, an intermediate sheet superposed to the lower sheet and including the sensitive material, and an upper sheet, impermeable to the ambient condition, and superposed to the intermediate sheet and shaped to be attached to an upper closure member. A first, relatively strong adhesive which is used to attach the lower sheet to the lower closure member and to the intermediate sheet, and to attach the upper sheet to the upper closure member. A second, relatively weak adhesive is used to join the upper surface of the intermediate sheet to the underside of the upper sheet at the peripheries of the sheets, so that upon opening the closure, the upper sheet is separated from the intermediate sheet, thereby exposing the sensitive material to ambient light. The adhesives are selected to be impermeable to the ambient conditions as well. The tamper-indicating device may be used with cellophane packages and inserted between upper and lower sheets and positioned to form an integral part of the heat sealed edges of such packages.

16 Claims, 9 Drawing Figures

TAMPER-INDICATING DEVICE AND METHOD

BACKGROUND OF THE INVENTION

The present invention relates to tamper-indicating devices used in combination with closures, and more particularly, to tamper-indicating devices which respond to stimulation from ambient elements such as light.

The average consumer has an increased awareness of the need for containers for consumables such as food, vitamins, medicines and the like which include devices that would give an indication that, subsequent to factory packaging, the container had been opened and the contents possibly tampered with. There have been many attempts to provide such containers. For example, some manufacturers of over-the-counter drugs have begun packaging their drugs in a container that is sealed within a second container, the latter of which must be destroyed in order to reach the inner container. A disadvantage of this type of packaging is that, while it does afford some measure of protection and reassurance to the ultimate purchaser, the cost of packaging is literally doubled, since two containers are required instead of one.

Another solution to this problem, which is particularly adapted to use with bottled consumables such as vitamins or pain relievers, is to provide a paper or foil sheet which covers the bottle opening beneath the cap and is attached by pressure sensitive adhesives to the top of the bottle neck. To gain access to the interior of such a bottle, it is necessary to puncture or remove the sheet, so that a sheet which is damaged in any way would indicate that it would be unsafe to use the contents of the bottle. While considerably less expensive to implement than the aforementioned device, the use of an adhesive sheet has a disadvantage in that it is relatively easy to defeat. For example, the bottle cap can be unscrewed and the adhesive sheet removed from the bottle neck by a glue solvent, steaming or separation using a razor blade, then reattached. If the removal would be performed successfully, the sheet would give no indication that it had been removed and the contents of the bottle exposed.

A refinement of this type of device is disclosed in the Brochman U.S. Pat. No. 3,923,198 and Cornell U.S. Pat. Nos. 3,896,965 and 3,935,960. The Brochman and Cornell '965 patents each disclose a tamper indicator, particularly adapted for use with a can-type container for holding liquid consumables, such as fruit juices, and consists of a strip having a pressure sensitive adhesive on its underside for attachment to the top of the can to cover an opening formed in the top, and a stress-opacifiable material on a top layer. Attempts to remove the strip by pulling it from the top of the can causes the stress-opacifiable material to change in appearance and thereby provide a permanent indication that the top had been removed.

In the Cornell '960 patent, a tamper-indicator tape is disclosed which includes an upper layer having encapsulated, color-forming material. An attempt to remove the tape from the can top causes the capsules to rupture and the material to react with a dye precursor to form a colored dye which changes the appearance of the strip and indicates that the closure has been tampered with. A disadvantage with all of these tamper-indicating strips is that they are susceptible to removal from their associated containers by means which would not necessarily activate their appearance-changing mechanisms. For example, it is conceivable that an adhesive solvent could be utilized to dissolve the pressure sensitive adhesive of their lower layers to effect removal from the can, or that a razor blade could be used to separate the adhesive from the can surface.

Another disadvantage with all of the aforementioned tamper-indicating devices is that they are designed specifically and exclusively for use with bottle-type containers. Many types of consumables are packaged in bags formed from low density polyethylene sheets which are heat sealed along peripheral edges to form the container. It is conceivable that such containers could be opened, the contents adulterated or removed, and the opening resealed, without leaving an indication that this activity had occurred. Another disadvantage comes from handling abuses—from the initial packaging stage there can be impact abuse during loading and unloading from trucks, bumping abuse during shipments, and pressures applied during pricing and stocking stages as well as during handling by potential consumers. In such cases, the abuses could cause stress-opacification and/or capsule rupture even though the contents have not been disturbed.

Accordingly, there is a need for a tamper-indicating device which is relatively inexpensive to manufacture and implement, so that the overall cost of packaging is not increased to a prohibitive level. Furthermore, there is a need for a tamper-indicating device which is more difficult to defeat than the aforementioned prior art devices, which can be removed from the container to be protected, then re-attached without activating the indicator elements. It is also desirable that such a tamper-indicating device be capable of use with polyethylene bags having heat sealed borders as well as the commonly used capped bottles.

SUMMARY OF THE INVENTION

The present invention is a tamper-indicating device in which a sheet of material which reacts to an ambient condition is sandwiched between two sheets of impermeable material, the latter of which are attached to the closure portions of a container. The act of opening the container separates one of the impermeable sheets from the intermediate sheet, thereby exposing the intermediate sheet to the ambient condition. The material of the intermediate sheet is designed to effect an irreversible, time-delayed change in appearance in response to an ambient condition such as light or oxygen.

The ultimate consumer can quickly and easily determine whether the container has been tampered with by removing the closure and inspecting the intermediate layer of the tamper-indicating device. If it is unchanged at the time the container is opened, the purchaser would know that the contents have not been tampered with. If, however, the indicator has already changed in appearance, there would be a strong likelihood that the container had been opened previously, and that it would be unwise to use the contents of the container.

In one preferred embodiment, the tamper-indicating device is designed to be used with bottle-type containers. The sheets of material are disk-shaped and sized to fit between the bottle cap and upper annular surface of the bottle neck. The upper and lower impermeable disks are attached to the underside of the bottle cap and bottle neck, respectively, by a first relatively strong adhesive, and that same adhesive is used to bond the intermediate disk to the lower impermeable disk. A second, relatively weaker adhesive is used to bond the periphery of the intermediate disk to the underside of the upper disk.

The act of unscrewing the bottle cap from the bottle neck causes the relatively weaker adhesive to yield and allow the upper disk to separate from the intermediate disk, so that when the cap is removed, that disk is exposed to ambient condition, thereby initiating the time-delayed, irreversible change in appearance. An advantage of this device is that the irreversible change in appearance begins automatically by the act of removing the bottle cap from the bottle neck, before a potential tamperer has an opportunity to gain access to the tamper-indicating device in an attempt to defeat it or remove it from the bottle.

In another preferred embodiment, the upper, lower and photosensitive layers are in strip form and the device is sized to be placed along the heat sealed or crimped edges of a polyethylene bag. The edges of the bag are sealed around the device, which optionally includes pressure sensitive adhesives on the outer surfaces of the upper and lower strips to bond the device to the bag edges. The act of separating the heat sealed edges of the bag also acts to separate the upper strip from the sensitive inner strip, thereby exposing the latter to ambient condition. The opening of the package by the ultimate consumer would reveal either an unchanged intermediate strip or a strip which had been changed by a previous opening, thereby warning the consumer not to use the contents of the bag.

In one embodiment, the intermediate layer is made of a photosensitive material which effects a time-delayed change in appearance upon exposure to light. In another embodiment, an oxygen sensitive material is used which effects a time-delayed change in appearance upon exposure to the oxygen in ambient air. The outer layers of the sandwich are preferably made of a foil which is light and oxygen impermeable.

Accordingly, it is an object of the present invention to provide a tamper-indicating device which is relatively simple and inexpensive to manufacture and implement, and does not greatly increase the cost of packaging; a tamper-indicating device which is resistant to attempts to defeat it by removing it from its container without activating the tamper-indicating portion; a tamper-indicating device which effects a time-delayed and irreversible change in appearance in response to the act of opening the container prior to the opener's first opportunity to reach the tamper-indicating device; and a tamper-indicating device which can be applied to sealed polyethylene bags as well as to bottles.

Other objects and advantages of the present invention will be apparent from the following description, the accompanying drawings and the appended claims.

DETAILED DESCRIPTION OF THE PREFERRED EMBODIMENTS

Figure 1:
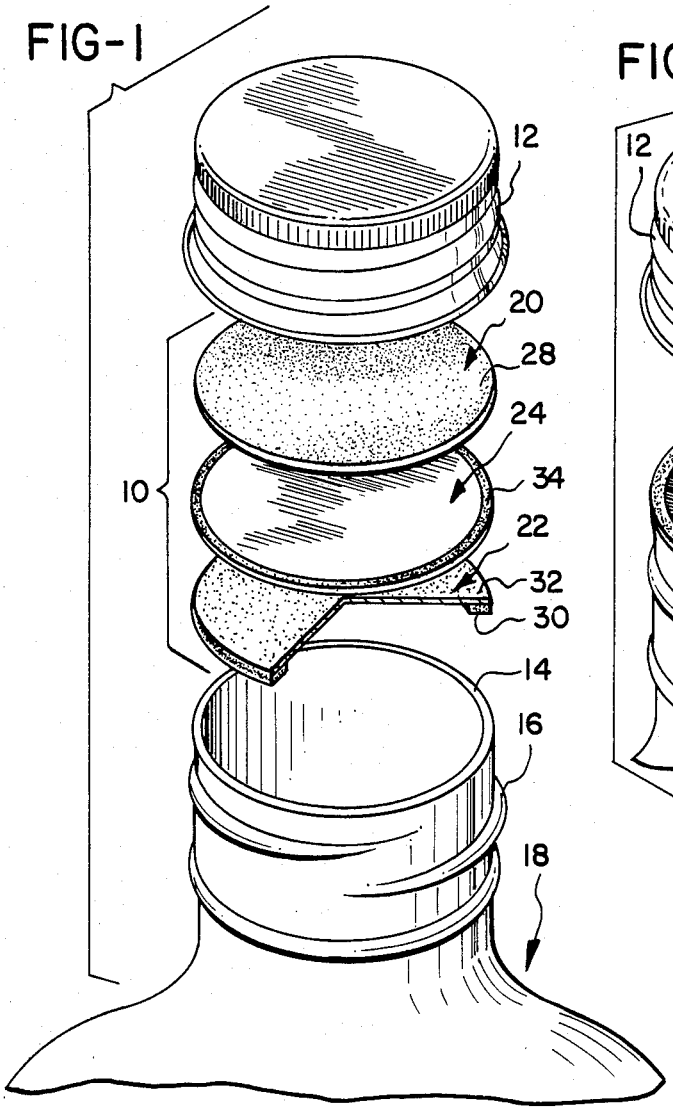
FIG. 1 is an exploded perspective view of a preferred embodiment of the invention in which an associated bottle and cap are shown.
Figure 2:
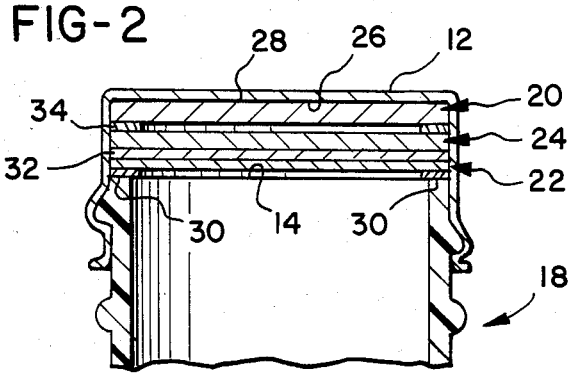
FIG. 2 is a side elevation in section of the embodiment of FIG. 1 in which the cap is secured to the bottle and the bottle is only partially shown.

As shown in FIGS. 1 and 2, the tamper-indicating device, generally designated 10, is sized and shaped to fit between the cap 12 and annular upper surface 14 of the bottle neck 16 of a bottle type container 18. The container 18 can be made of a glass or of a polyethylene plastic.

The device 10 includes upper and lower superposed sheets which are in the form of disks 20, 22, respectively, and are made of an opaque material such as metal foil. The intermediate sheet is in the form of a disk 24 and is made of a photosenstive material which effects an irreversible, time-delayed change in appearance when exposed to light. Examples of such material are Panalure II RC, catalog No. 1808872, or Ektamatic SC, catalog No. 1919950, both manufactured by Eastman Kodak Co., Rochester, N.Y. It is within the scope of the invention to use other types of material, well-known in the art, which effect a time-delayed change in appearance in response to light exposure which is irreversible.

As best shown in FIG. 2, the upper disk 20 is attached to the underside 26 of the bottle cap 12 by a layer 28 of a relatively strong adhesive such as Aeroset 1911, manufactured by Ashland Chemical Co., Columbus, Ohio. Similarly, the lower disk 22 is attached at its underside to the upper annular surface 14 by an annular layer 30 of the same relatively strong adhesive. The lower disk 22 is attached at its upper surface to the underside of the intermediate disk 24 by a layer 32 of the strong adhesive, and the seal should be sufficiently complete to prevent light from leaking through the layer 32 to the intermediate disk 24.

The upper surface of the intermediate disk 24 is bonded to the underside of the upper disk 20 by an annular layer 34 of a relatively weaker adhesive, such as Aeroset 1085 manufactured by Ashland Chemical Co., Columbus, Ohio. It is within the scope of the invention to use other types of well-known adhesives, provided the adhesive used in layers 28, 30, 32 is stronger than that used in layer 34.

The upper, intermediate and lower disks, 20–24 are assembled using darkroom techniques well-known in the art. The completed device 10 is placed between the cap 12 and annular surface 14 of the bottle subsequent to the loading of the bottle with its contents, so that the act of screwing the cap onto the bottle neck 16 attaches the upper disk 20 to the underside 28 of the bottle cap 12, and the lower disk 22 to the upper surface 14 of the bottle neck 16.

Figure 3:
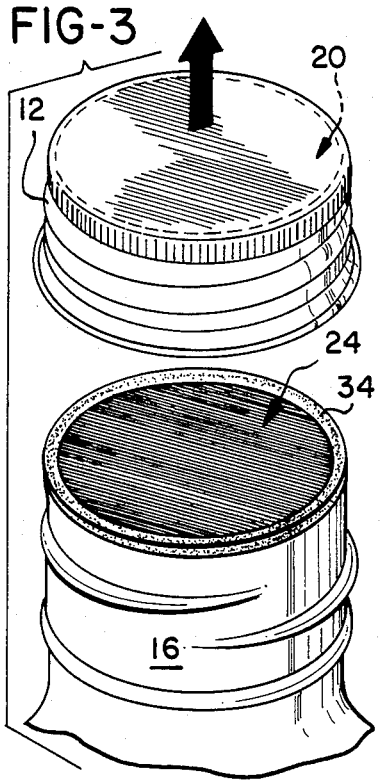
FIG. 3 is an exploded perspective view of the device of FIG. 1 in which the photosensitive intermediate layer has been irreversibly changed in appearance.

As shown in FIG. 3, removal of the bottle cap 12 from the bottle neck 16 causes the device 10 to separate at the relatively weak connection between the upper disk 20 (FIG. 2) and the intermediate disk 24, thereby exposing the photosensitive material of the intermediate disk to ambient light. The nature of the photosensitive material is such that it effects a time-delayed change in appearance which, once completed, is irreversible. If the aforementioned Panalure or Ektamatic materials are used for disk 24, a subsequent removal of the bottle cap 12 from the bottle neck 16 will reveal a dark-colored intermediate disk as shown in FIG. 3.

Figure 4:
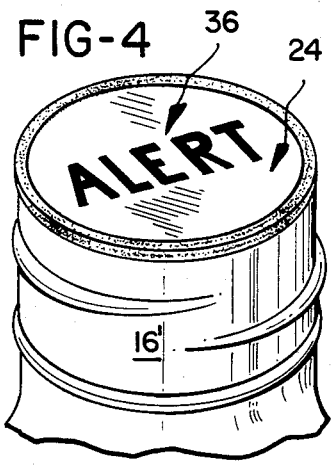
FIG. 4 is a modified embodiment of the device in FIG. 1 in which the photosensitive portion of the intermediate sheet is in the form of an identifying indicia.

As an alternative, the photosensitive intermediate disk 24 can be modified as shown in FIG. 4 to include photosensitive material in the form of a warning indicia 36, in the illustrated case spelling the word "ALERT." The intermediate disk 24 can be modified such that the photosensitive material forms different warning indicia, or the disk can include an opaque overlay (not shown) having a transparent portion in the shape of the indicia, and not depart from the scope of the invention.

Figure 5:
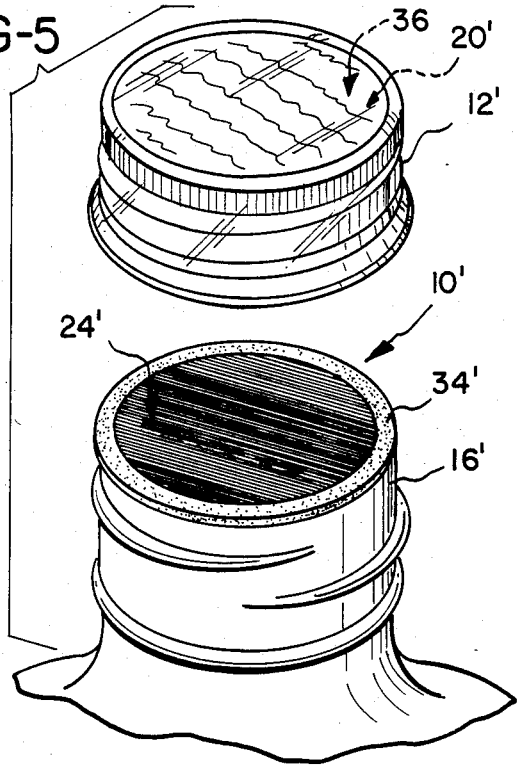
FIG. 5 is an exploded, perspective view of an alternate modification of the embodiment of FIG. 1.

As shown in FIG. 5, the tamper-indicating device 10' can be modified to employ additional tamper-indicating features. The upper disk 20' of the device 10' includes on its upper surface a stress-opacifying indicator layer 37. Such a layer preferably is formed from a 1–10 mill (25–250 micron) film of normally transparent stress-opacifying unplasticized polyvinyl chloride. Other suitable stress-opacifying materials would include films of polybutadiene/polystyrene, polyvinyl chloride/polyvinyl acetate and isotactic polypropylene/butyl rubber blends. The upper disk 20' is bonded, using a layer (not shown) of the stronger adhesive, to the underside of a cap 12' which is made of a transparent plastic material, so that the stress-opacifying indicator layer 37 can be viewed through the top of the cap. It is preferable to form a trademark or other identifying indicia on an upper surface (not shown) of disk 20' which could be viewed through the layers of adhesive, the stress-opacifying layer 37 and cap 12'.

By unthreading the cap 12' from the bottle neck 16', the torsional forces transmitted between the weaker adhesive layer 34' and the underside of the upper disk 20' cause at least a portion of the stress-opacifying layer 36 to change color and obscure the trademark on the upper disk 20' and thereby provide additional means for indicating to the ultimate purchaser that the cap 12 has been removed. Of course, the photosensitive material of the intermediate disk 24' will irreversibly change color to inicate to the ultimate purchaser that the cap 12' has been removed in a manner similar to that with the embodiments of FIGS. 1–4.

Figure 6:
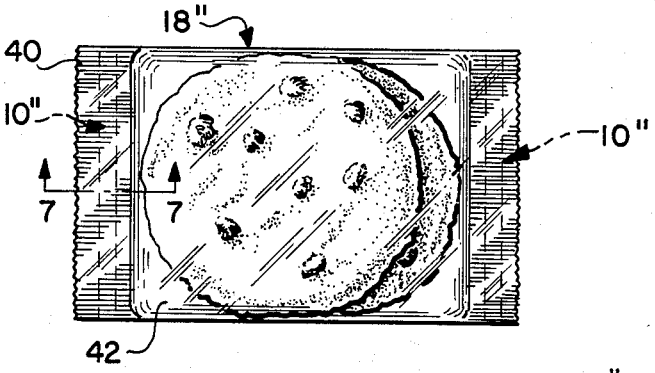
FIG. 6 is a top plan view of a heat sealed polyethylene bag incorporating a second preferred embodiment of the invention.
Figure 7:
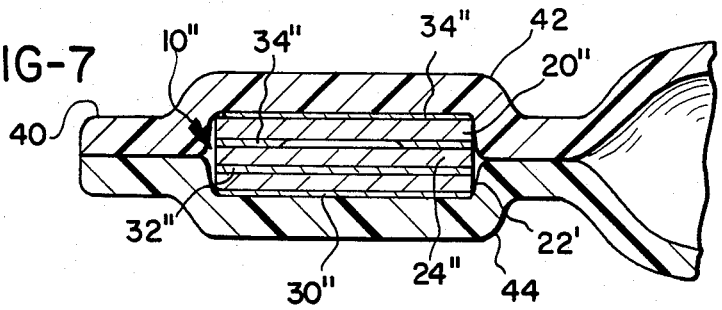
FIG. 7 is a detail of a side sectional view of the embodiment of FIG. 6 taken at line 7—7 of FIG. 6.

As shown in FIGS. 6 and 7, an alternate embodiment of the tamper-indicating device 10'' consists of superposed sheets comprising upper and lower strips 20'', 22'' of opaque material which enclose an intermediate strip 24'' of photosensitive material. The devices 10'' are arranged around the heat sealed periphery 40 of a package made of upper and lower low density polyethylene sheets 42, 44.

In a manner similar to that for the embodiments of FIGS. 1–5, the lower strip 22'' is bonded to the lower sheet 44 by a layer 30'' of strong adhesive; and the upper strip 20'' is bonded to the upper sheet 42 by a layer 34'' of strong adhesive. The intermediate strip 24'' is bonded to the lower strip 22'' by a strong adhesive layer 32'', and to the underside of the upper strip 20'' by parallel tracks forming a layer 34'' of weak adhesive so that a central surface of photosensitive material is not covered by the adhesive. Layer 34'' should extend about the periphery of strip 24'' to form a light-proof seal.

The act of separating the upper and lower sheets 42, 44 at a heat sealed periphery 40 causes the upper strip 20'' to separate from the intermediate, photosensitive strip 24'', thereby exposing the photosensitive layer to ambient light to initiate the aforementioned irreversible change in appearance. Therefore, even if the opened portion of the periphery 40 is resealed by heat sealing, the ultimate purchaser will be warned that the heat sealed periphery has been opened previously by the change in appearance of the intermediate layer 24''.

With all of the embodiments of the invention, the aforementioned Panalure II RC and Ektamatic SC photographic papers are suitable, and will darken from white to blue after several minutes in response to a relatively short exposure to ambient light. With the embodiment shown in FIG. 4, only the word "ALERT" would turn the dark blue. Of course, it is within the scope of the invention to provide a strip type device 10'' in which the intermediate layer 24'' is modified such that the word "ALERT" appears in a pattern along its length, thereby obviating the need to include explanatory language on the cover of the package to inform the ultimate purchaser that the darkened color is a warning.

Figure 8:
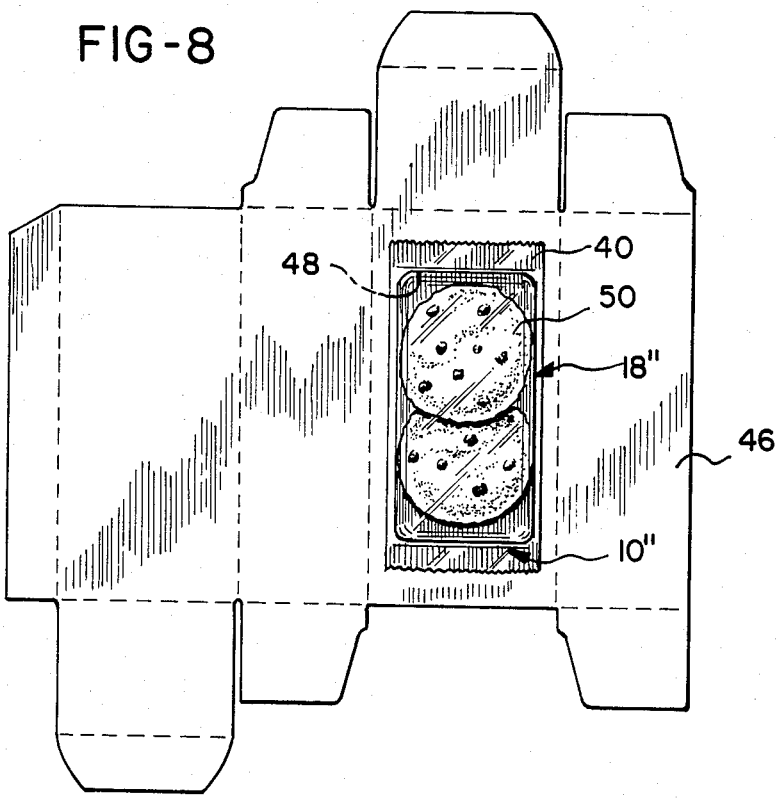
FIG. 8 is a top plan view of the container shown in FIG. 6 attached to a box blank.

The container 18'' shown in FIGS. 6 and 7 can be combined with an outer box-type container 46 shown in FIG. 8. The box container 46 includes a rectangular window opening 48 so that the contents 50 of the set up container can be viewed by the ultimate purchaser.

A method of fabricating this type of container would include the steps of first placing the tamper-indicating strips 10'', as well as the product 50 between the upper and lower sheets 42, 44 of the container 18'', then effecting a heat seal about the periphery 40 of the container to seal the contents 50 and the tamper-indicating strips 10'' between the sheets. The next step is to attach the completed container 18'' to the box container blank 46 such that the contents 50 may be viewed through the window 48. The box blank is then set up by well-known means to form the finished container.

In an alternate method, the lower sheet 44 is first attached to the box blank 46 by a suitable adhesive (not shown) so that it is centered over the window 48. The product 50 and tamper-indicating strips 10'' are then placed on the lower sheet 44 in the locations shown in FIG. 8. The upper sheet 42 is then placed over the product 50 and tamper-indicating strips 10'', and a heat seal is effected about the periphery 40 by well-known means. The blank 46 is then set up to form the container. The tamper-indicating strips 10'' aid in the assembly of the containers in this method in that they act to hold the upper sheet 42 in place prior to the heat sealing step.

Figure 9:
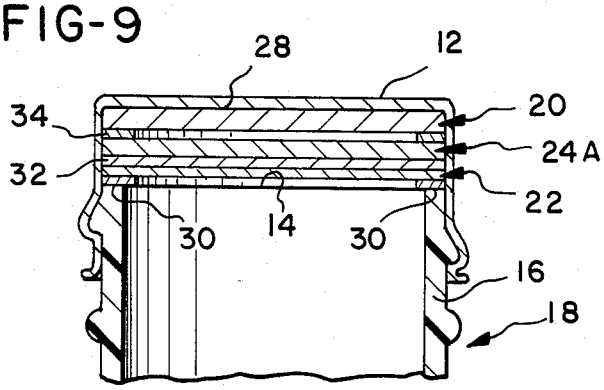
FIG. 9 is a side elevation in section of an alternate embodiment of the invention utilizing an intermediate sheet of oxygen sensitive material.

As shown in FIG. 9, an intermediate sheet 24A may be used which is made of a material sensitive to atmospheric oxygen. Such materials are well-known and are disclosed in Jackson U.S. Pat. No. 3,480,402, the disclosure of which is incorporated herein by reference. For example, sheet 24A may be made of filter paper impregnated with leucomethylene blue, combined with a reducing agent such as sodium hydrosulfite which retards the rate of color change. The upper and lower disks 20, 22, respectively, are made of a foil such as aluminum which is impermeable to oxygen, and the adhesives forming layers 30, 32, 34 should likewise be impermeable by oxygen.

As with the embodiment shown in FIGS. 1 and 2, removal of cap 12 from bottle neck 16 causes disk 20 to be separated from and expose the upper surface of disk 24A to ambient air, thereby causing an irreversible, time-delayed change in color of the disk 24A. If leucomethylene blue is used, an irreversible, time-delayed change in color, from clear to blue, occurs. The amount of leucomethylene blue and sodium hydrosulfite to be used will be apparent to one having skill in the art.

While the forms of apparatus herein described constitute preferred embodiments of this invention, it is to be understood that the invention is not limited to these precise forms of apparatus, and that changes may be made therein without departing from the scope of the invention.

What is claimed is:

1. A tamper-indicating device comprising:

a lower impermeable sheet shaped to be attached at an underside thereof to a lower closure member;

an intermediate sheet superposed to said lower sheet and including means on an upper surface thereof sensitive to an ambient condition, said sensitive means adapted to effect a time-delayed change in appearance of said upper surface in response to exposure to the ambient condition;

an upper impermeable sheet superposed to said intermediate sheet and shaped to be attached at an upper surface thereof to an upper closure member;

first adhesive means for attaching said lower sheet to a lower closure member and to said intermediate sheet, and for attaching said upper sheet to an upper closure member; and second adhesive means, weaker than said first adhesive means, for joining said upper surface of said intermediate sheet to an underside of said upper sheet at outer peripheries thereof to form a substantially impermeable seal.

2. The device of claim 1 wherein said upper impermeable sheet is shaped to be mounted on an underside of a bottle cap; and said lower impermeable sheet is shaped to be mounted on an annular upper surface of a bottle neck.

3. The device of claim 1 wherein said upper and lower impermeable sheets are sized to fit between crimped edges of a plastic package.

4. The device of claim 2 wherein said upper and lower sheets are disk-shaped and are equal in size.

5. The device of claim 4 wherein said second adhesive means is in an annular pattern, and said intermediate sheet is disk-shaped with a diameter substantially equal to that of said upper and lower sheets.

6. The device of claim 1 wherein said sensitive means is in the form of a warning indicia.

7. The device of claim 1 wherein said sensitive means is coextensive with said intermediate sheet.

8. The device of claim 1 wherein said intermediate sheet comprises light sensitive paper; and said impermeable sheets comprise opaque foil.

9. The device of claim 1 wherein said upper impermeable sheet includes a layer of a stress-opacifying material such that an attempt to separate said intermediate sheet therefrom changes the visual appearance of an upper surface of said layer.

10. The device of claim 1 wherein said upper, intermediate and lower sheets are in the form of elongate strips shaped to be placed between heat sealed edges of a plastic bag, and said second adhesive means forms tracks about a periphery of said intermediate strip.

11. The device of claim 1 wherein said intermediate sheet includes an oxygen sensitive substance on an upper surface thereof; and said upper and lower sheets and said adhesive means are substantially impermeable to oxygen.

12. The device of claim 11 wherein said oxygen sensitive substance is leucomethylene blue; and said upper and lower sheets comprise aluminum foil.

13. A tamper-indicating device comprising:

a lower disk-shaped opaque sheet shaped to be attached at an underside thereof to an annular upper surface of a bottle neck;

an intermediate disk-shaped sheet, having a diameter substantially the same as that of said lower sheet and including photosensitive means on an upper surface thereof, said photosensitive means adopted to effect a time-delayed change in appearance of said upper surface in response to light exposure;

an upper disk-shaped opaque sheet superposed to and having substantially the same diameter as said intermediate and lower sheets;

first adhesive means for attaching an upper side of said upper sheet to a bottle cap, and for attaching an upper side of said lower sheet to an underside of said intermedite sheet and a lower side of said lower sheet to a bottle neck; and second adhesive means, weaker than said first adhesive means, for joining said upper surface of said intermediate sheet to an underside of said upper sheet at outer peripheries thereof, such that an act of removing an associated bottle cap from a corresponding bottle neck causes said upper sheet to be separated from said intermediate sheet.

14. A method of assembling a tamper-indicating package comprising the steps of:

placing an object to be packaged between upper and lower sheets of transparent material;

placing a tamper indicator between said sheets and along outer peripheries thereof, said tamper indicator including a lower strip impermeable to an ambient condition, an intermediate strip superposed to said lower strip and including means on an upper surface thereof sensitive to an ambient condition, said sensitive means adapted to effect a time-delayed change in appearance of said upper surface in response to said ambient condition, an upper strip impermeable to said ambient condition superposed to said intermediate strip, first adhesive means, impermeable to said ambient condition, for attaching said lower strip to said lower sheet and said intermediate strip, and for attaching said upper strip to said upper sheet, and second adhesive means, impermeable to said ambient condition, and weaker than said first adhesive means, for joining said upper strip to said upper sheet; and forming a heat seal about said peripheries of said sheets, thereby sealing said object therebetween and sealing said tamper indicator within said heat seal.

15. The method of claim 14 further comprising the step of attaching said package to a box blank having a window such that said package covers said window.

16. The method of claim 14 wherein said placing step further comprises the steps of attaching said lower sheet to a box blank having a window such that said lower sheet covers said window; placing said object upon said lower sheet; and superposing said upper sheet to said lower sheet.

* * * * *